US005995075A

United States Patent [19]

Vignolle

[11] Patent Number: 5,995,075

[45] Date of Patent: Nov. 30, 1999

[54] OPTIMIZED METHOD OF ADDRESSING A LIQUID-CRYSTAL SCREEN AND DEVICE FOR IMPLEMENTING IT

[75] Inventor: Jean-Michel Vignolle, Moirans, France

[73] Assignee: Thomson - LCD, Paris, France

[21] Appl. No.: 08/776,272

[22] PCT Filed: Aug. 2, 1995

[86] PCT No.: PCT/FR95/01038

§ 371 Date: Jan. 22, 1997

§ 102(e) Date: Jan. 22, 1997

[87] PCT Pub. No.: WO96/04640

PCT Pub. Date: Feb. 15, 1996

[30] Foreign Application Priority Data

Sep. 2, 1994 [FR] France ..... 94 09586

[51] Int. Cl.[6] ..... G09G 3/36

[52] U.S. Cl. ..... 345/94; 345/100; 345/208

[58] Field of Search ..... 345/55, 58, 60, 345/61, 90, 98, 100, 87, 94, 208; 348/625, 626, 792; 349/33, 34, 35, 54

[56] References Cited

FOREIGN PATENT DOCUMENTS

| | | |
|---|---|---|
| 0539185 | 4/1993 | European Pat. Off. . |
| 0574920 | 12/1993 | European Pat. Off. . |
| 63-107380 | 5/1988 | Japan . |
| 5-181113 | 7/1993 | Japan . |
| 7-49670 | 2/1995 | Japan . |
| 7-287554 | 10/1995 | Japan . |

*Primary Examiner*—Dennis-Doon Chow
*Attorney, Agent, or Firm*—Joseph S. Tripoli; Joseph J. Laks; Sammy S. Henig

[57] ABSTRACT

The present invention relates to an optimized method of addressing liquid-crystal screens. In accordance with the invention, the matrix addressing method, periodically scanning each line with a signal of voltage $V_A(t)$ as a function of time, is characterized in that each period of this signal consists of a plateau up to $T_F$ then a curve which may be a straight-line portion of slope $\alpha$ between $T_F$ and $T_{F'}$. Application to liquid-crystal screens.

5 Claims, 2 Drawing Sheets

OPTIMIZED METHOD OF ADDRESSING A LIQUID-CRYSTAL SCREEN AND DEVICE FOR IMPLEMENTING IT

FIELD OF THE INVENTION

The present invention relates to a method of addressing a liquid-crystal screen allowing a display of uniform quality over the entire line of the screen, as well as to a device for implementing this method.

BACKGROUND OF THE INVENTION

A liquid-crystal screen consists of a set of image elements ("pixels", standing for picture element), each formed by an electrode and by a counter electrode framing the liquid crystal, the value of the field between these electrodes altering the optical properties of the liquid crystal. The voltage at the terminals of the electrodes of the pixels is delivered via addressing columns by peripheral circuits ("drivers") by virtue of the control transistors of these pixels, the conducting or non-conducting state of these transistors being determined by selection lines coming from other line drivers.

FIG. 1 represents a selection line Lj of a liquid-crystal screen with m lines and n columns, controlling the transistors T1 to Tn of the pixels P1 to Pn. This line is connected to a line driver which delivers, at A, the square selection signal $V_A(t)$ as represented in FIG. 2. The signal $V_A(t)$ causes the transistors T1 to Tn of the line $L_j$ to conduct, and thus allows the electrodes of the pixels $P_i$ to be polarized by the video signal coming from the columns $C_1$ to $C_n$. The capacitances $C_{c1}$ represent the capacitive couplings between the line $L_j$ and the counter electrode CE through the liquid crystal. This line $L_j$, the end of which is floating, constitutes a delay line which causes distortion of the selection signal at point B by comparison with point A; this signal $V_B(t)$ at point B is represented in FIG. 2. This is visible particularly when it is desired to display a uniform image and when the same voltage is applied to all the columns $C_1$ to $C_n$ of the screen. At the instant $t_F$, the voltage at the terminals of the capacitances $C_p$ formed by the electrodes of the pixels $P_i$ and the counter electrode CE is the same. However, after the instant $t_F$ this is no longer the case due to the difference between the shapes of the signals $V_A(t)$ and $V_B(t)$.

This is because, at point A, the voltage drop is very fast, the transistor $T_1$ is therefore turned off immediately after $t_F$. Moreover, a stray capacitance $C_p$ exists between the line $L_j$ and the pixels $P_i$. The voltage drop $\Delta V_G$ at point A thus, by capacitive coupling, causes a voltage drop on the pixel which is:

$$\Delta V_1 = C_p / C_{pi} \times \Delta V_G$$

If $V_1$ is the voltage supplied to the pixel $P_1$ by the column $C_1$, the voltage drop $\Delta V_1$ on the pixel at the instant when the transistor $T_1$ ceases to conduct is illustrated by FIG. 3*a,* $V_{ce}$ being the voltage on the counter electrode.

At point B, the phenomenon of capacitive coupling is identical, but in this case the transistor $T_n$ continues to conduct as long as the voltage $V_B(t)$ is greater than $V_1+V_t$, where $V_t$ is the threshold voltage of the transistor. The coupling $\Delta V_n$ between the line $L_j$ and the last pixel $P_n$ is therefore weaker than $\Delta V_1$, since, as long as the transistor $T_n$ is conducting, the voltage at the terminals of the pixels remains equal to the voltage delivered by the column $C_n$. The capacitive coupling thus causes a voltage drop for the pixel $P_n$:

$$\Delta v_n = C_p / C_{pi} \times \Delta V',$$

$\Delta V'$ being the voltage drop at point B.

The voltage which allows the pixels to alter the optical properties of the liquid crystal is therefore $V_{pix1}=V_1-V_{ce}$ in the case of the pixel $P_1$ and $V_{pixn}=V_n-V_{ce}$ in the case of the pixel $P_n$, $V_{pix1}$ being different from $V_{pixn}$. It is this which is represented in FIG. 3*b.* The grey level is therefore not the same at the start and at the end of line. This problem called "horizontal shading" is particularly important in the case of large-size screens.

One solution frequently used, and described in the document SID 94 Digest, page 263, consists in using a counter-pulse to reduce this effect. This solution is expensive since it requires more complicated drivers to be produced.

Another solution frequently used consists in reducing the resistivity of the lines. However, this implies increasing the thickness of the metal used to produce the line, which renders the process more expensive and more difficult to keep control of.

The present invention proposes a simple and effective solution to this problem of "horizontal shading".

SUMMARY OF THE INVENTION

The method according to the invention in fact consists in periodically scanning each line with a signal of time-varying voltage, each period of which consists of a plateau and a preferably negative slope the value of which is less than the value of the characteristic slope of the delay line at the end of line.

These characteristics can easily be implemented by virtue of drivers having a VDD analogue input allowing the high level VH to be controlled, such as, for example, the Toshiba drivers of the T6A02/T6A03 type.

Moreover, this method also makes it possible to reduce the coupling and thus the stray voltages on a screen.

BRIEF DESCRIPTION OF THE DRAWINGS

The present invention will be better understood and its additional advantages will emerge on reading the description which will follow, illustrated by the following figures.

DETAILED DESCRIPTION OF THE INVENTION

Figure 1:
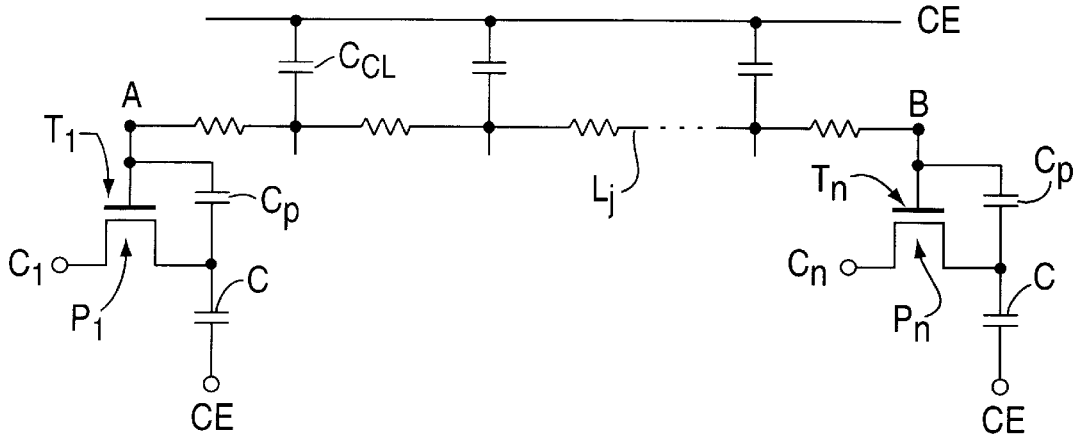
FIG. 1, already described, is a diagram of an example of lines of a liquid-crystal screen.
Figure 2:
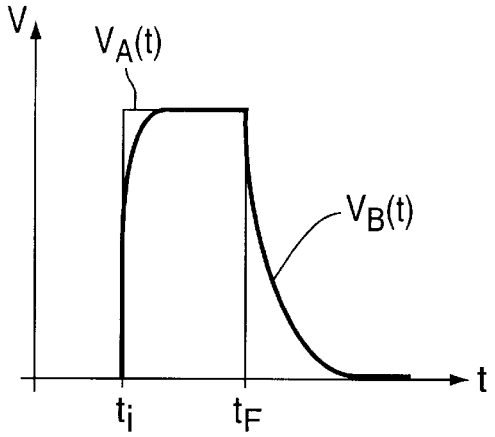
FIG. 2, already described, represents the selection signal as it is received at the end of line and at the start of line, and illustrates the problem posed by the delay of the line.
Figure 3A:
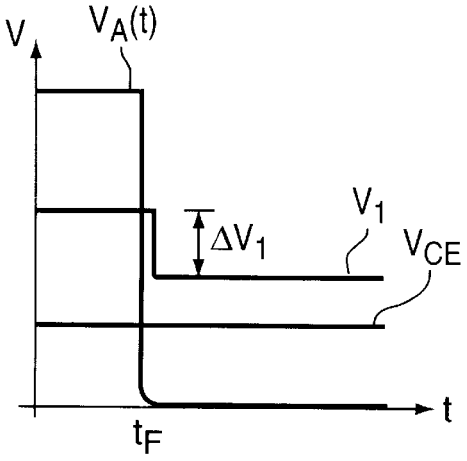
FIGS. 3*a* and 3*b* represent the voltages of the pixels at the start and end of line.
Figure 3B:
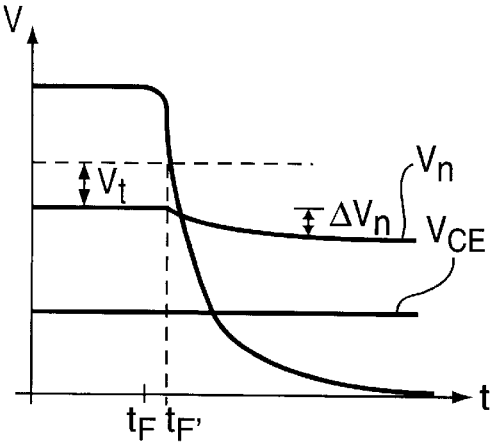
Figure 4A:
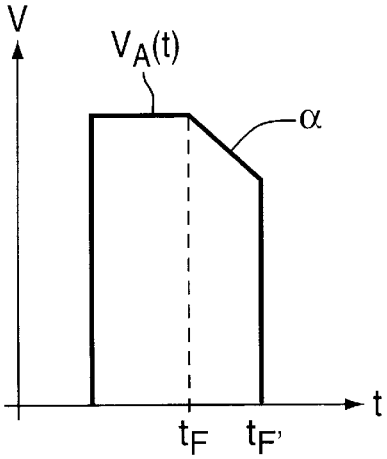
FIGS. 4*a* and 4*b* represent the signals according to the invention respectively, received at the start and end of line respectively.

An embodiment of the present invention is represented by FIG. 4*a,* and consists in altering the shape of the signal delivered by the selection circuit so as to compensate for the delay effect of the line responsible for the horizontal shading. After a plateau of a width, for example, of 28 $\mu$s, and according to one important characteristic of the invention, the signal $V_A(t)$ does not decrease abruptly (after a plateau of duration $t_F-t_i$), but, from $t_F$, with a slope $\alpha$ preferably less than or equal to the characteristic slope of the delay line at point B, that is to say that $\alpha$ is less than $\Delta V/\tau$, $\tau$ being the characteristic time of the delay line at B and $\Delta V$ the potential drop at point A. An example of the value of $\alpha$ may be a few volts per $\mu$s. This signal thus decreases until the voltage $V_A(t)$ is equal to $V_{F'}$, at which voltage the transistors T1 to Tn are turned off. From this instant $t_{F'}$ the signal drops instantaneously.

Figure 4B:
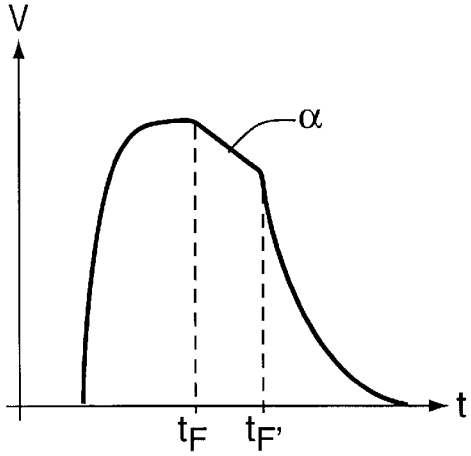

Thus, between $t_F$ and $t_{F'}$ (the duration $t_{F'}-t_F$ may be equal to 3 $\mu$s for 6 volts, for example), the signal is the same at point A and B, all the transistors of the line maintaining constant voltages on the pixels. The selection signal, with delay, complete with a slope $\alpha$ between $t_F$ and $t_{F'}$, is represented in FIGS. 4*b*.

Figure 5A:
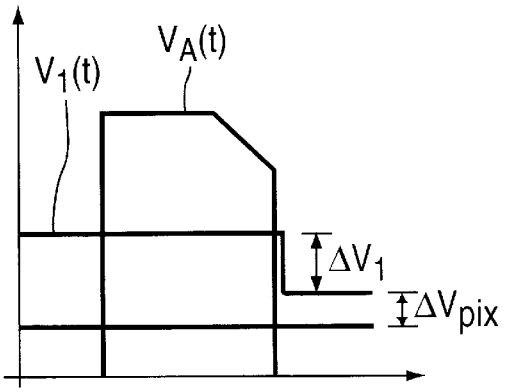
FIGS. 5*a* and 5*b* represent the voltages of the pixels controlled according to the invention at the start and end of line respectively.
Figure 5B:
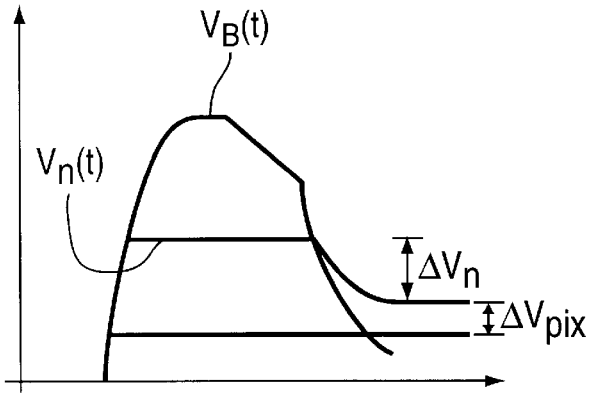

From the instant $T_{F'}$, the transistors $T_1$ and $T_n$ are turned off, the coupling is therefore $\Delta V_1=\Delta V_2=C_p/C\times\Delta V$. The voltages at the terminals of the pixels $P_1$ and $P_n$ are illustrated respectively by FIGS. 5*a* and 5*b*. It will be noted that the voltages on the pixels $P_1$ to $P_n$ are equal and consequently that there is no horizontal shading.

A refinement of the method consists in using, between $t_F$ and $t_{F'}$, a curve which is not a straight-line portion but a portion of a function f(t) which remains unchanged by the transfer function of the delay line: applying f(t) to $T_1$ results in applying f(t−T) on $T_n$, T being a delay. f(t) may, for example, be a sinusoid or a sum of sinusoids.

This method according to the invention can be implemented by a driver having an input which makes it possible to control the output current. By severely limiting the output current between $t_F$ and $t_{F'}$, it is possible to alter the standard signal so as to obtain the desired waveform.

Figure 6:
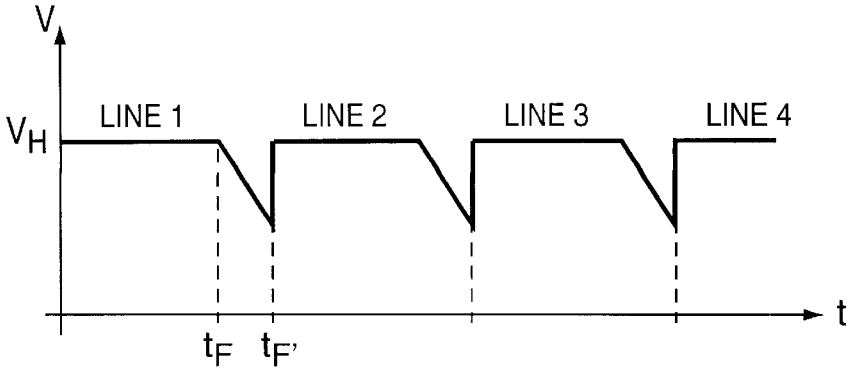
FIG. 6 represents the shape of the reference high level of a driver allowing the invention to be implemented.

It is also possible to use drivers which have an analogue input which makes it possible to define the high level $V_H$. The desired signal is obtained at the output of the driver by modulating this input in such a way as to obtain a wave $V_H$ having an inverse sawtooth shape as illustrated by FIG. 6. That is to say, at each line 1, 2, 3, 4, etc., the high level $V_H$ is maintained on a plateau over a line period up to the instant $T_F$, then lowered linearly until the instant $T_{F'}$, when instantly raised back to the said plateau in order to scan the following line.

The present invention can be used for repairing flat liquid-crystal screens. In fact, known repair procedures exist, but they do not work as they increase the RC of the repaired line, which renders it visible since it does not experience the same coupling as the adjacent lines. By using the larger of the characteristic times of the repaired line or normal lines as $\tau$, the repaired lines become similar to the adjacent lines.

The present invention applies to the control of flat liquid-crystal screens including peripheral or integrated drivers, and in particular to large-size screens.

I claim:

1. A method of matrix addressing in a structure comprising selection lines and data lines and having a switching element at the intersection of said selection and data lines controlled by a signal applied on said selection lines, said method comprising periodically scanning each selection line with a periodic voltage signal as a function of time applied to a control input of the switching element, each period of said periodic voltage signal comprising a plateau portion and then a curve portion, said curve portion chosen to pass from a value of the plateau portion to a value corresponding to a turn-off voltage of the switching element to compensate for voltage differences along said selection line, wherein said periodic voltage signal is delivered by an addressing circuit having an analog input making it possible to define a high level in an output and modulated by a periodic inverse sawtooth signal of selection line period.

2. The method according to claim 1, wherein said selection line constitutes a delay line having a characteristic slope and wherein the curve portion is a straight-line portion of slope, the value of the slope being less than a value of a characteristic slope of the delay line at a terminal portion of said line.

3. The method according to claim 2, wherein the slope is a negative slope.

4. A method of matrix addressing in a structure comprising selection lines and data lines, at the intersection of which is a switching element controlled by a signal applied on said selection lines, said selection lines constituting delay lines having an initial portion associated with a first switching element and a terminal portion associated with a last switching element, said method comprising periodically scanning each line with a periodic signal of voltage as a function of time applied to a control input of each switching element, beginning with said first switching element and proceeding to said last switching element, each period of said voltage signal comprising a plateau portion and then a curve portion, wherein the curve portion is a straight-line portion of a slope, the value of the slope being less than a value of a characteristic slope of the delay line at the terminal portion of said line.

5. The method according to claim 4, wherein the slope is a negative slope.

* * * * *